US007350263B2

(12) United States Patent
Yoshimi et al.

(10) Patent No.: US 7,350,263 B2
(45) Date of Patent: Apr. 1, 2008

(54) ELECTRIC VACUUM CLEANER

(75) Inventors: Kazuyoshi Yoshimi, Hyogo-ken (JP); Kazumasa Kamatani, Hyogo-ken (JP); Shuzo Ueyama, Kasai (JP); Hiroyuki Takami, Kasai (JP); Kouichi Nakai, Himeji (JP)

(73) Assignee: Sanyo Electric Co., Ltd, Osaka-Fu (JP)

( * ) Notice: Subject to any disclaimer, the term of this patent is extended or adjusted under 35 U.S.C. 154(b) by 625 days.

(21) Appl. No.: 10/788,118

(22) Filed: Feb. 25, 2004

(65) Prior Publication Data

US 2004/0163202 A1 Aug. 26, 2004

(30) Foreign Application Priority Data

Feb. 26, 2003 (JP) ..... 2003-049360

(51) Int. Cl.
*A47L 5/28* (2006.01)

(52) U.S. Cl. ..... 15/331; 15/334; 15/335

(58) Field of Classification Search ..... 15/328, 15/331, 334, 335
See application file for complete search history.

(56) References Cited

U.S. PATENT DOCUMENTS 2,876,481 A 3/1959 Gerber et al.
3,879,797 A * 4/1975 Principe et al. ..... 15/334
4,571,772 A * 2/1986 Dyson ..... 15/335
5,309,600 A * 5/1994 Weaver et al. ..... 15/328
5,331,715 A 7/1994 Johnson et al.
5,815,883 A * 10/1998 Stein et al. ..... 15/327.1
6,058,559 A * 5/2000 Yoshimi et al. ..... 15/328
6,317,920 B1 11/2001 Brickner et al.
2003/0101535 A1* 6/2003 Gammack et al. ..... 15/335

FOREIGN PATENT DOCUMENTS

EP 0437017 7/1991
JP 05261030 A * 10/1993
JP 2002-233483 * 8/2002
JP 2002233482 8/2002

OTHER PUBLICATIONS

Patent Abstracts of Japan, Publication No. 2002-233482 Date of Publication: Aug. 20, 2002.

* cited by examiner

*Primary Examiner*—David Redding

(57) ABSTRACT

An electric vacuum cleaner including a vacuum cleaner main body, a suction tool main body connected to the vacuum cleaner main body and having an suction inlet which is open at a lower surface thereof, a dust box connected to the vacuum cleaner main body, and a grip portion for operating the vacuum cleaner main body. The suction tool main body, an interior of the vacuum cleaner main body, the grip portion and the dust box are directly connected in this order such that circulation of air is permitted. The interior of the vacuum cleaner main body and the grip portion are connected in a freely attachable and detachable manner.

3 Claims, 13 Drawing Sheets

ELECTRIC VACUUM CLEANER

CROSS-REFERENCE TO RELATED APPLICATION

Priority is claimed under 35 U.S.C. 119 from Japanese patent application 2003-49360 filed Feb. 26, 2003.

BACKGROUND OF THE INVENTION

The present invention relates to an electric vacuum cleaner. More particularly, it relates to an upright type electric vacuum cleaner which can perform both, floor cleaning and handy cleaning using an attachment, wherein the electric vacuum cleaner is of simple arrangement which does not require a switching mechanism for switching between a flow path for ordinary use and a flow path for use with an attachment.

An upright type electric vacuum cleaner, which is capable of cleaning not only floors but also places other than floors such as walls, is conventionally known. Such an upright type electric vacuum cleaner is provided with two flow paths, namely a main body flow path which extends from a suction tool main body to a dust chamber of a vacuum cleaner main body and a flow path for handy cleaning which extends to the dust chamber (refer to Japanese Unexamined Patent Publication No. 233482/2002). A flexible hose which forms the flow path for handy cleaning is in communication with a grip portion connected to an upper part of the vacuum cleaner main body in a freely attachable and detachable manner. For performing handy cleaning, the grip portion can be detached from the vacuum cleaner main body so as to use the same as an attachment for handy cleaning.

However, it is the case with such a vacuum cleaner having two flow paths that, owing to the fact that the suction efficiency is apt to be degraded, a flow path switching mechanism for selectively closing one flow path which is not in use needs to be provided, which results in a complicated overall structure. For instance, the electric vacuum cleaner as disclosed in the above reference is provided with a flow path opening and closing means for handy cleaning which closes the flow path for handy cleaning in a condition in which the vacuum cleaner main body is inclined for performing floor cleaning while it opens the flow path for handy cleaning in a condition in which the vacuum cleaner main body is uprising, and the overall structure is thus complicated.

SUMMARY OF THE INVENTION

The present invention has been made for solving such a problem, and it is an object thereof to provide an upright type electric vacuum cleaner which can perform both floor cleaning and handy cleaning using an attachment, wherein the electric vacuum cleaner is of simple arrangement which does not require a switching mechanism for switching between a flow path for ordinary use and a flow path for use with the attachment.

In accordance with the present invention, there is provided an electric vacuum cleaner including a vacuum cleaner main body, a suction tool main body connected to the vacuum cleaner main body and having a suction inlet which is open at a lower surface thereof, a dust box connected to the vacuum cleaner main body, and a grip portion for operating the vacuum cleaner main body. The suction tool main body, an interior of the vacuum cleaner main body, the grip portion and the dust box are directly connected in this order such that circulation of air is permitted, and the interior of the vacuum cleaner main body and the grip portion are connected in a freely attachable and detachable manner.

It is preferable that a packing is provided at a connecting portion of the flow path between the interior of the vacuum cleaner main body and the grip portion.

It is preferable that the suction tool main body and the interior of the vacuum cleaner main body are connected through a connecting hose and that the connecting hose is connected to the suction tool main body in a freely attachable and detachable manner.

It is preferable that at least a part of the connecting hose is extensible and that a part of the connecting hose is housed in the interior of the vacuum cleaner main body.

DETAILED DESCRIPTION

Figure 1:
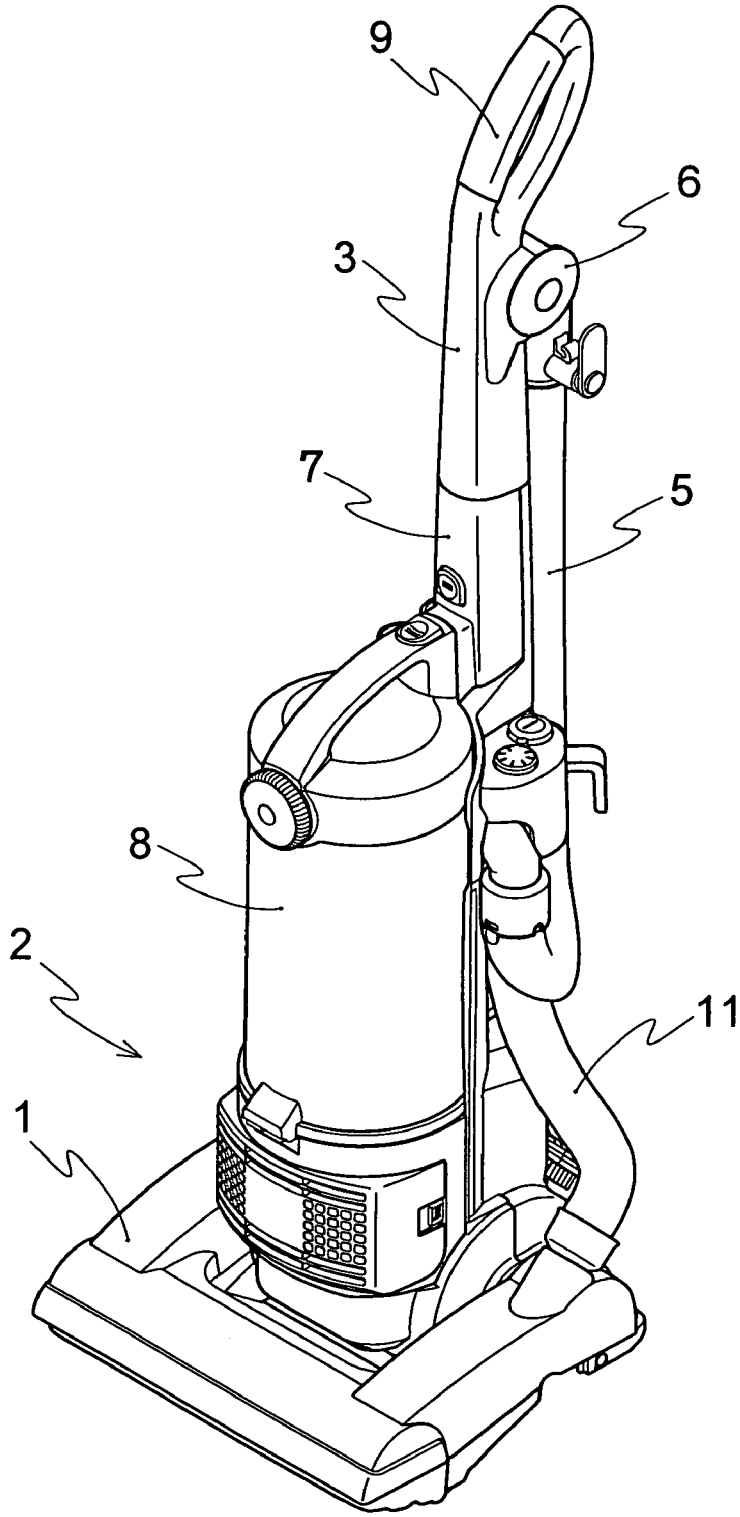
FIG. 1 is a perspective explanatory view illustrating one embodiment of the electric vacuum cleaner according to the present invention.
Figure 2:
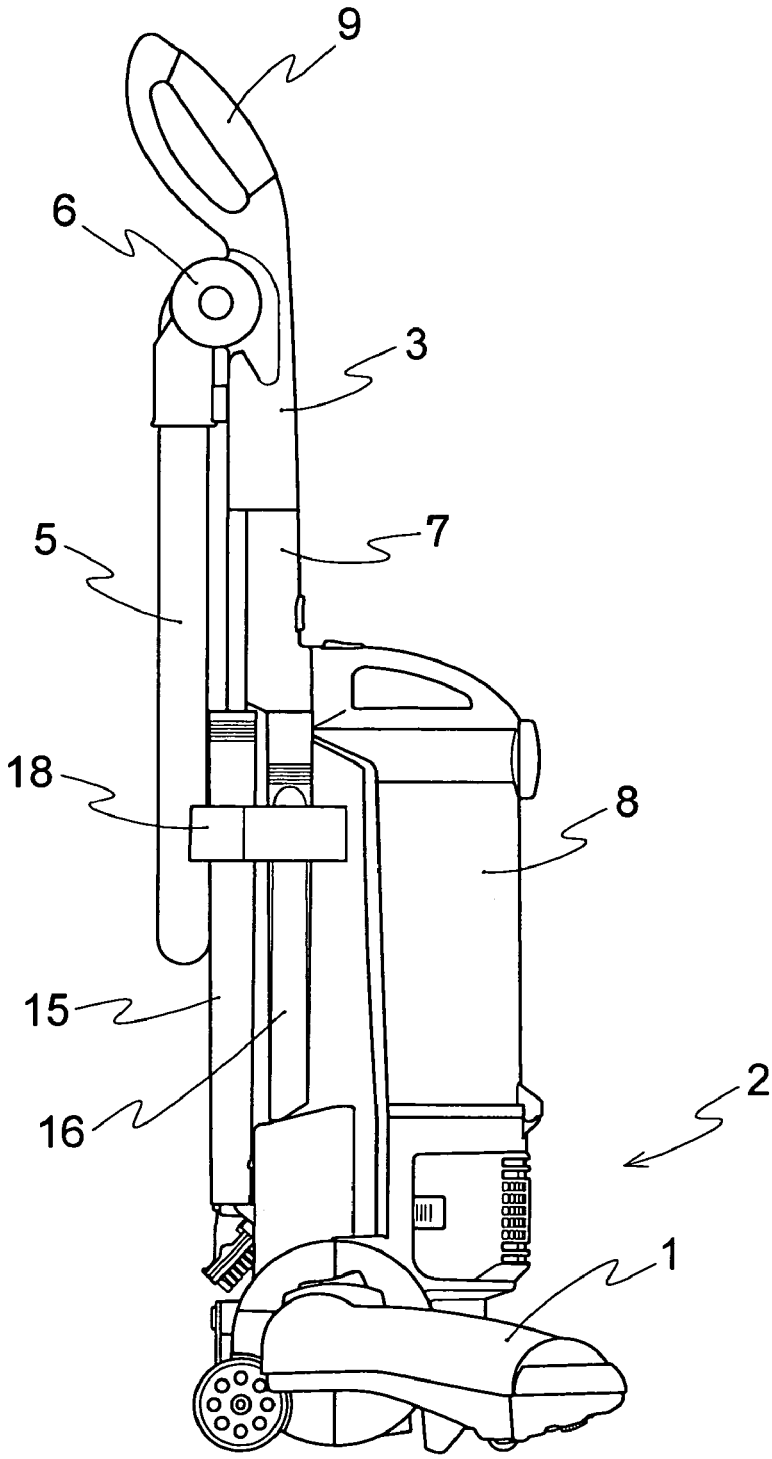
FIG. 2 is a side view of the electric vacuum cleaner of FIG. 1 when seen from the left-hand side.

The electric vacuum cleaner of the present invention will now be explained in details with reference to the drawings.

The upright type electric vacuum cleaner illustrated in FIGS. 1 to 6 is composed of a suction tool main body 1, a vacuum cleaner main body 2, a grip portion 3, a tip end side pipe 4 fixedly attached to the grip portion 3, a flexible hose 5, and a rotatable tube 6. A tip end portion of the tip end side pipe 4 is inserted into a tubular tip end side pipe supporting portion 7 of the vacuum cleaner main body 2 to be supported thereby in a freely attachable and detachable manner.

The suction tool main body 1 includes a suction inlet at a lower surface thereof and a rotating brush (not shown) inside of the suction inlet. The suction tool main body 1 is communicated with a rear portion 12 of the vacuum cleaner main body 2 through a connecting hose 11.

An electric air blower 10 is incorporated in the vacuum cleaner main body 2, and a dust box 8 is provided at an upper portion of the vacuum cleaner main body 2. The suction tool main body 1 is provided at a lower portion of the vacuum cleaner main body 2 to be freely rotating in front and rear directions through a fulcrum (not shown) which is provided at the vacuum cleaner main body 2.

The grip portion 3 comprises of a hollow tubular body, and a grip 9 is formed at an upper end thereof. The tip end side pipe 4 and the flexible hose 5 are connected through this grip portion 3. Further, the grip portion 3 is connected to the tip end side pipe supporting portion 7 in a freely attachable and detachable manner, and it is also connected to the dust box 8 located at an upper portion on a front surface side of the vacuum cleaner main body 2 through the flexible hose 5 which is disposed on a rearward side of the grip portion 3.

In a condition in which the grip portion 3 is connected to the tip end side pipe supporting portion 7, the tip end side pipe 4 is connected to the connecting hose 11 in the interior of the rear portion 12 of the vacuum cleaner main body 2, so that the grip portion 3 is in communication with the suction tool main body 1 through both of the tip end side pipe 4 and the connecting hose 11.

Figure 5:
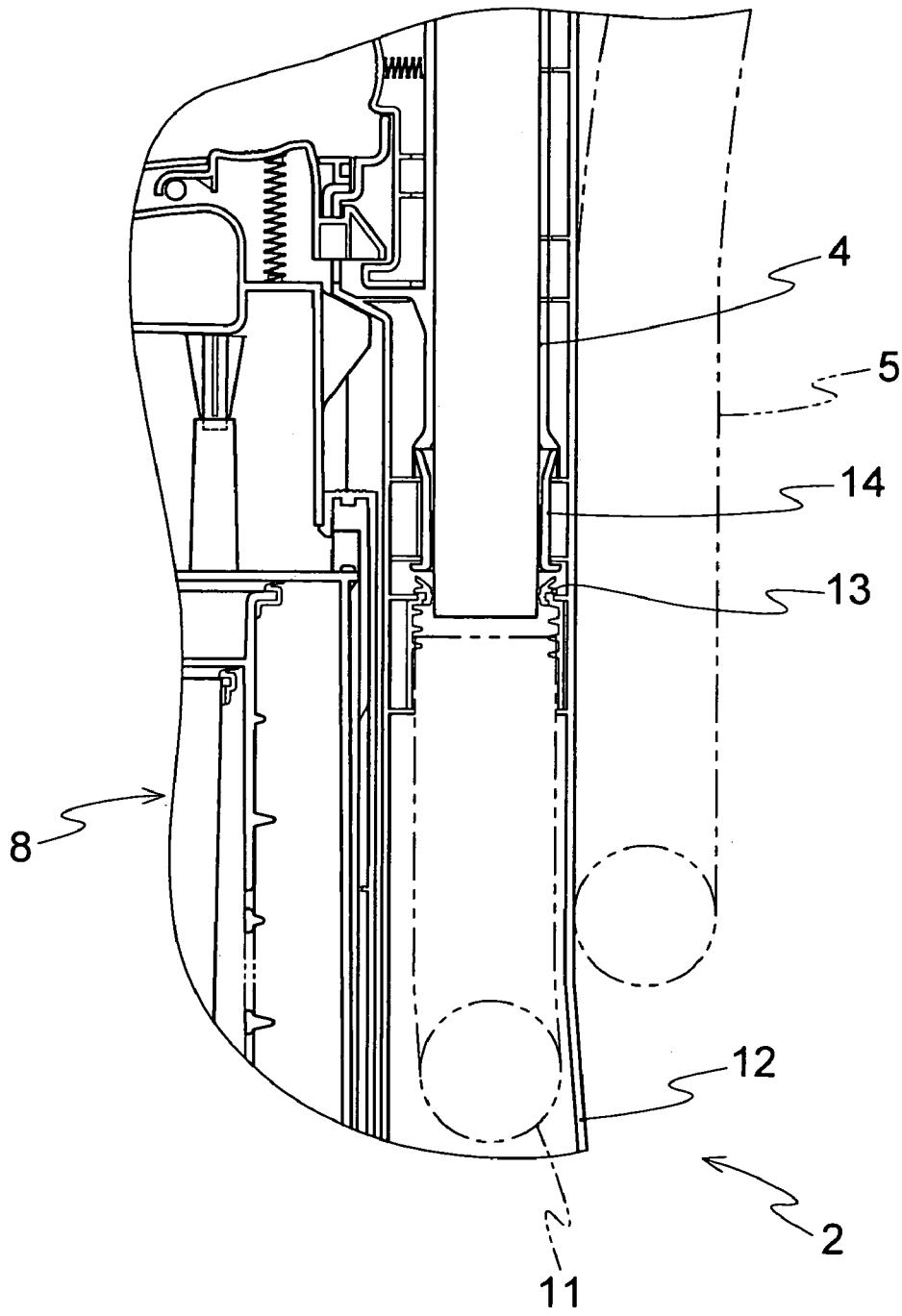
FIG. 5 is a partially enlarged sectional view of a rear inside portion of the vacuum cleaner main body of FIG. 1.
Figure 6:
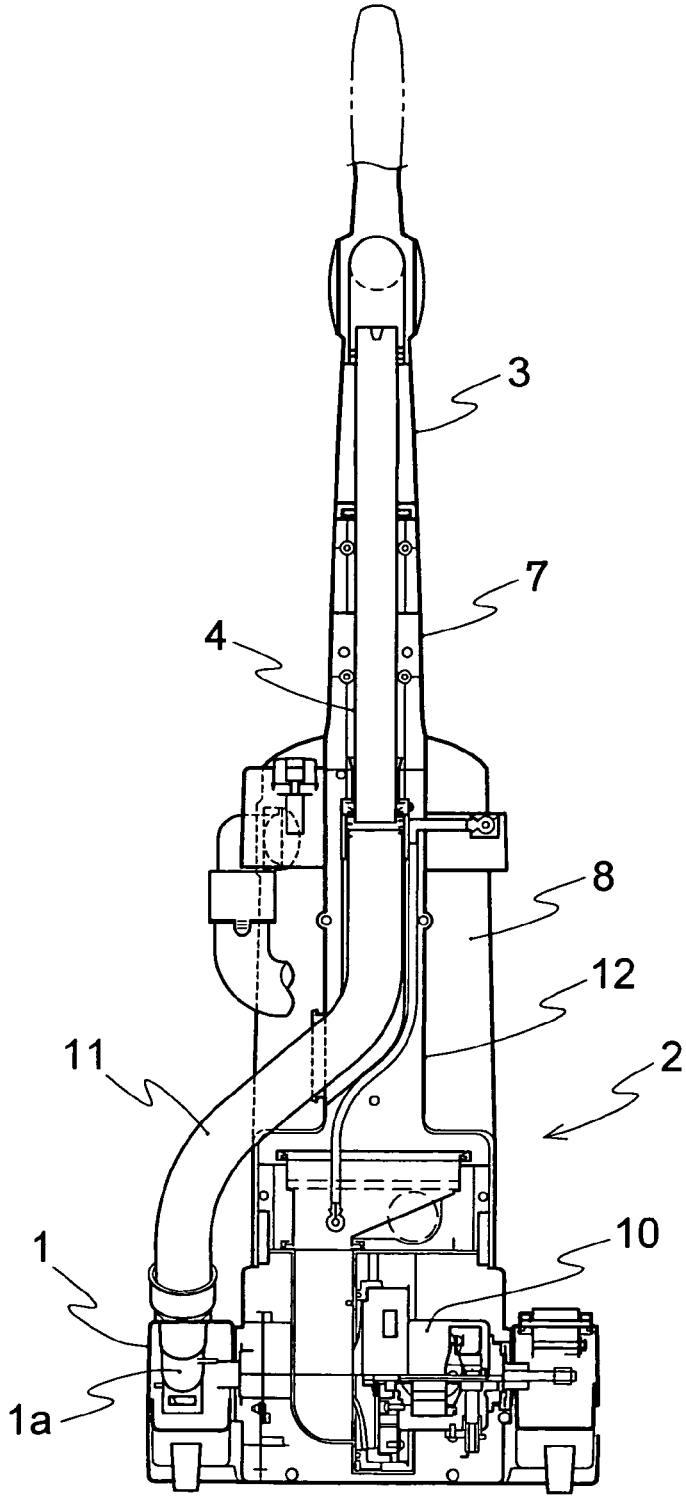
FIG. 6 is a view when a section along a width direction of the electric vacuum cleaner of FIG. 1 is seen from the rear side.

In the present embodiment, a packing 13 is provided inside of the rear portion 12 of the vacuum cleaner main body 2 for maintaining an air-tight condition between the rear portion 12 and the grip portion 3 as illustrated in FIGS. 5 and 6. The connecting hose 11 is connected to a lower portion of the packing 13 through screwing or similar means by utilizing concave and convex portions of the accordion-like connecting hose 11. An inner peripheral surface of the packing 13 projects inside in the radial direction so that it might abut an outer peripheral surface of the tip end side pipe 4 of the grip portion 3, and the tip end side pipe 4 might be maintained in an air-tight condition thereby. A guide member 14 for guiding the tip end side pipe 4 to the center of the packing 13 is provided above the packing 13.

In the upright type electric vacuum cleaner of the present invention having the above-described arrangement, the suction tool main body 1, the rear portion 12 of the vacuum cleaner main body 2, the grip portion 3 and the dust box 8 are directly connected in this order such that circulation of air is permitted, and the rear portion 12 of the vacuum cleaner main body 2 and the grip portion 3 are connected in a freely attachable and detachable manner. With this arrangement, it is possible to perform both ordinary use (floor cleaning) using the suction tool main body 1 and use of an attachment through the grip portion 3 by utilizing one successive flow path, so that it is possible to omit a flow path switching mechanism to thereby simplify the structure.

Figure 4:
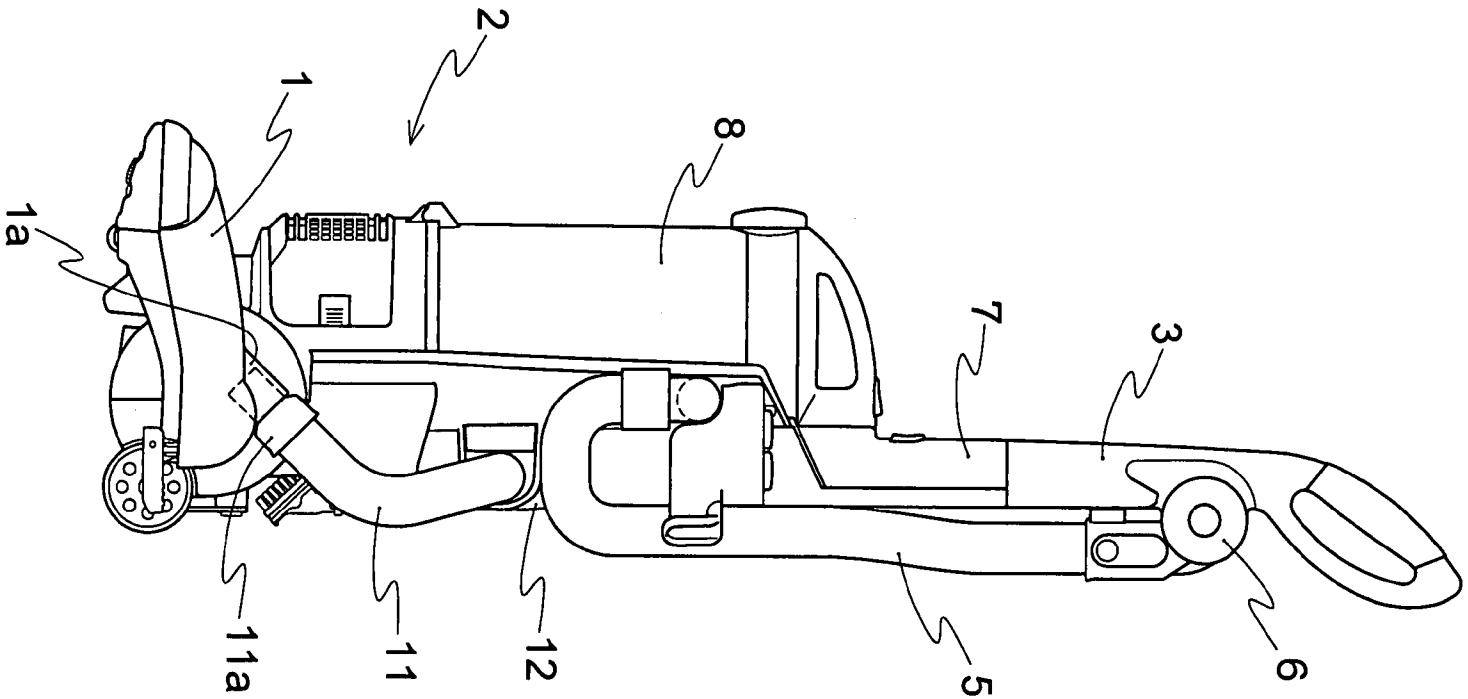
FIG. 4 is a side view of the electric vacuum cleaner of FIG. 1 when seen from the right-hand side.

At the time of ordinary use in which floor cleaning is performed, dust sucked through the suction tool main body 1 passes through the connecting hose 11, the tip end side pipe 4, the grip portion 3 and the flexible hose 5 in this order as illustrated in FIGS. 4 to 6 and is accumulated in the dust box 8.

Figure 7:
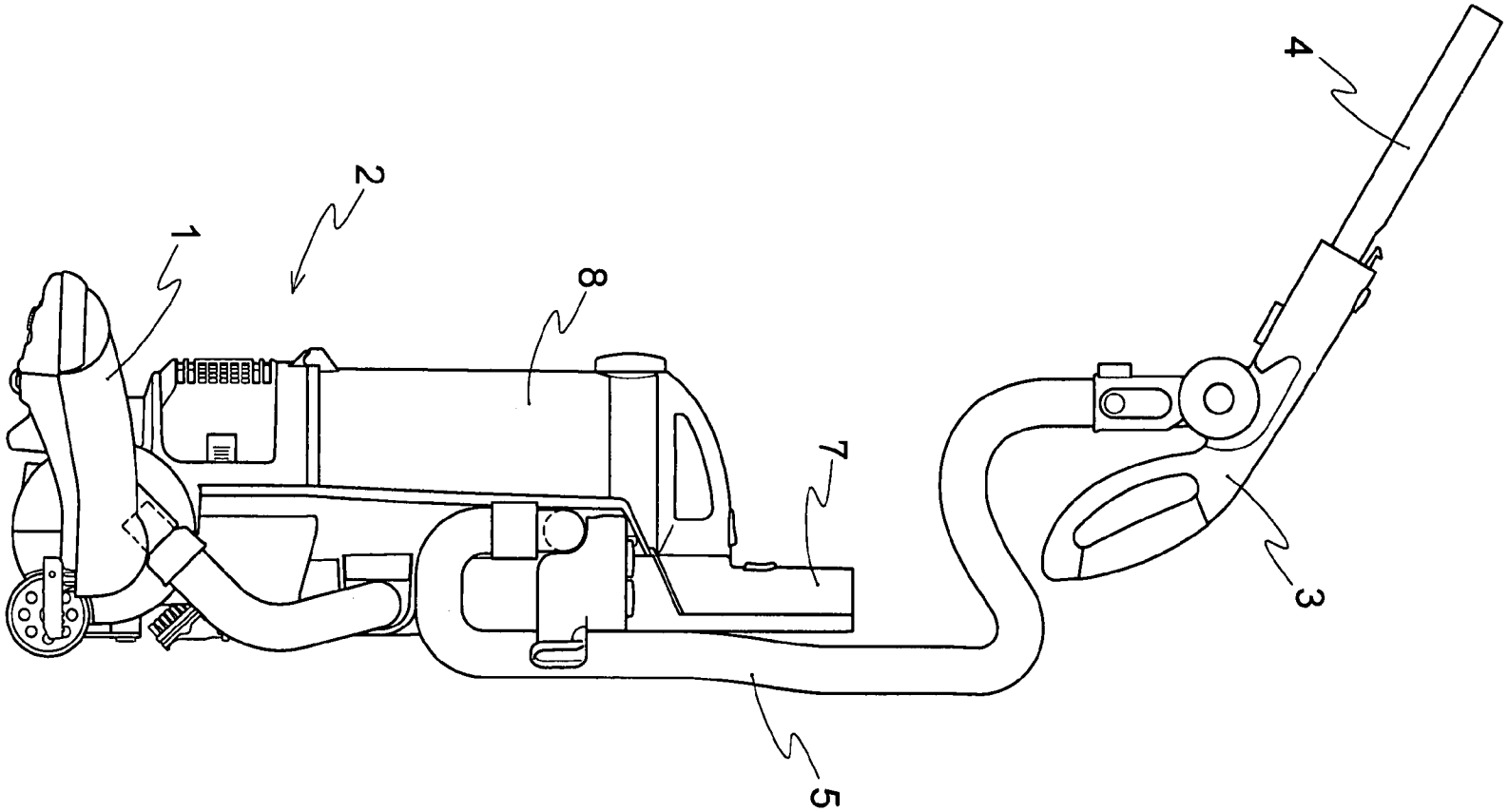
FIG. 7 is an explanatory view when an attachment of the electric vacuum cleaner of FIG. 1 is being used.

Further, as illustrated in FIG. 7, when the tip end side pipe 4 of the grip portion 3 is drawn out from the tip end side pipe supporting portion 7 of the vacuum cleaner main body 2, the grip portion 3 might be used as an attachment so that it is possible to clean ceilings or walls located at high positions.

Moreover, in the present embodiment, the portion between the suction tool main body 1 and the rear portion 12 of the vacuum cleaner main body 2 is connected through the connecting hose 11 as illustrated in FIGS. 4 and 6 to 8, and the connecting hose 11 is connected to the suction tool main body 1 in a freely attachable and detachable manner. More concretely, an adapter 11*a* at an end portion of the connecting hose 11 is inserted into an air inlet 1*a* of the suction tool main body 1 in a freely attachable and detachable manner. Accordingly, when the connecting hose 11 is drawn out from the suction tool main body 1 to change from the condition of ordinary use of FIG. 4 to the condition of FIG. 8, the connecting hose 11 might be used as an attachment, and detailed spots located at lower positions, for instance, door-sills or comers between walls and floors can be easily cleaned. That is, since it is possible to use the connecting hose 11 also as an attachment in the present embodiment, aspects of cleaning can be remarkably enlarged thereby.

Figure 8:
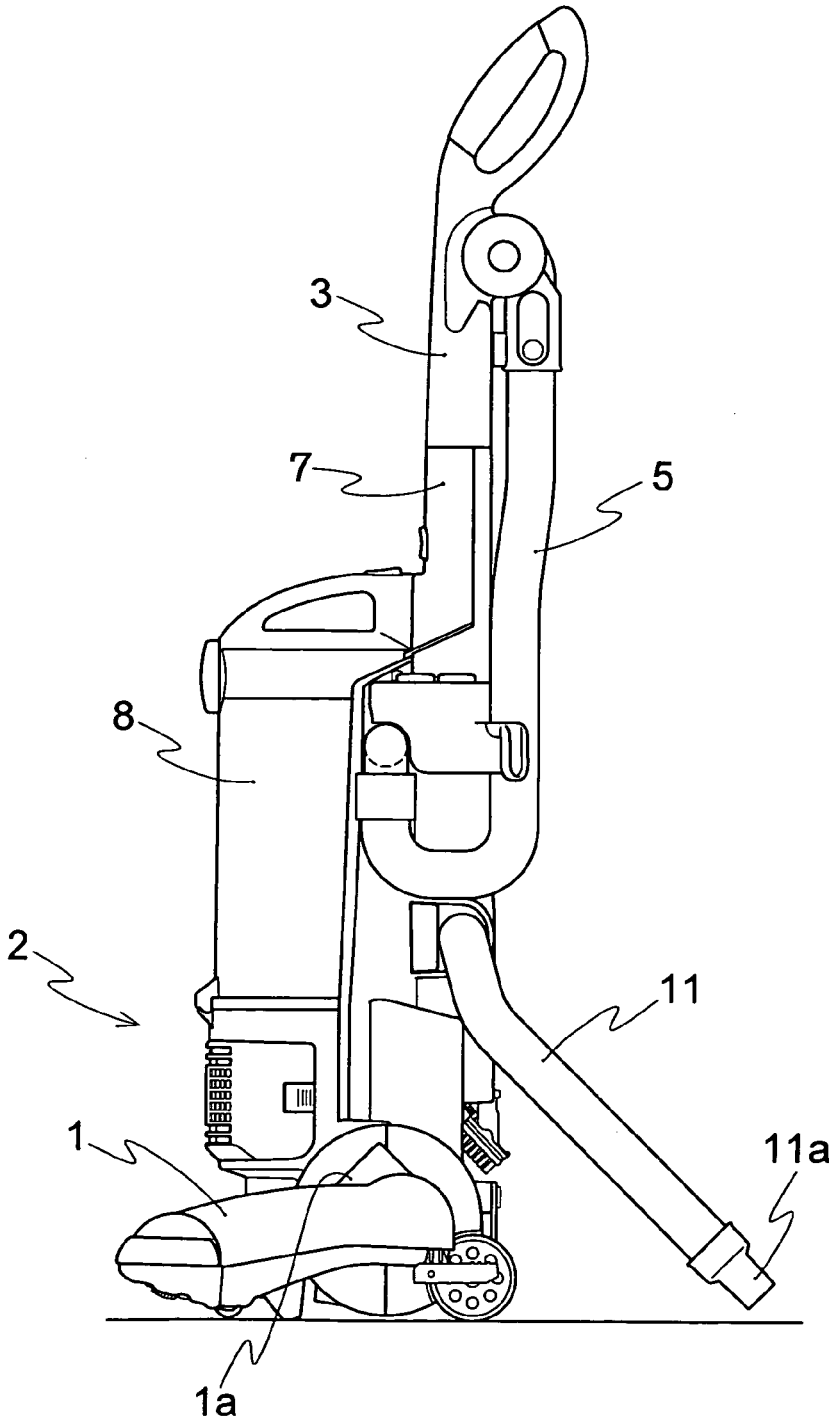
FIG. 8 is an explanatory view when a connecting hose of the electric vacuum cleaner of FIG. 1 is being used as an attachment.

In this respect, regardless of whether using the grip portion 3 as illustrated in FIG. 7 or the connecting hose 11 as illustrated in FIG. 8, it is possible to use them by attaching an ordinarily used extension pipe 15, a pipe for crevice 16 (see FIG. 2) or a brush for furniture 17 (see FIG. 3) to their tip ends.

Moreover, the present embodiment is so arranged that at least a part of the connecting hose 11 is extensible and a part of the connecting hose 11 is housed in the rear portion 12 of the vacuum cleaner main body 2. Accordingly, the connecting hose 11 is extended only by a length which is necessary for connection with the suction tool main body 1 for ordinary use as illustrated in FIGS. 4 and 6, while the remaining portion is housed in the rear portion 12 of the vacuum cleaner main body 2 in the shrunk condition so as to improve its external appearance. On the other hand, when the connecting hose 11 is to be used as an attachment, the connecting hose 11 shall be drawn out from the rear portion 12 of the vacuum cleaner main body 2 so as to improve the degree of freedom of the swinging movements of the hose. It is accordingly possible to perform cleaning of a broader region using the connecting hose 11.

In this respect, while it is sufficient that at least a part of the connecting hose 11 is extensible so that it might be housed in the rear portion 12, it is also possible that the entire connecting hose 11 is extensible.

As explained so far, while the present embodiment is so arranged that the suction tool main body 1 and the rear portion 12 of the vacuum cleaner main body 2 are connected through the connecting hose 11, the present invention is not limited to this arrangement, and it is also possible to directly connect the suction tool main body 1 and the rear portion 12 of the vacuum cleaner main body 2.

Figure 3:
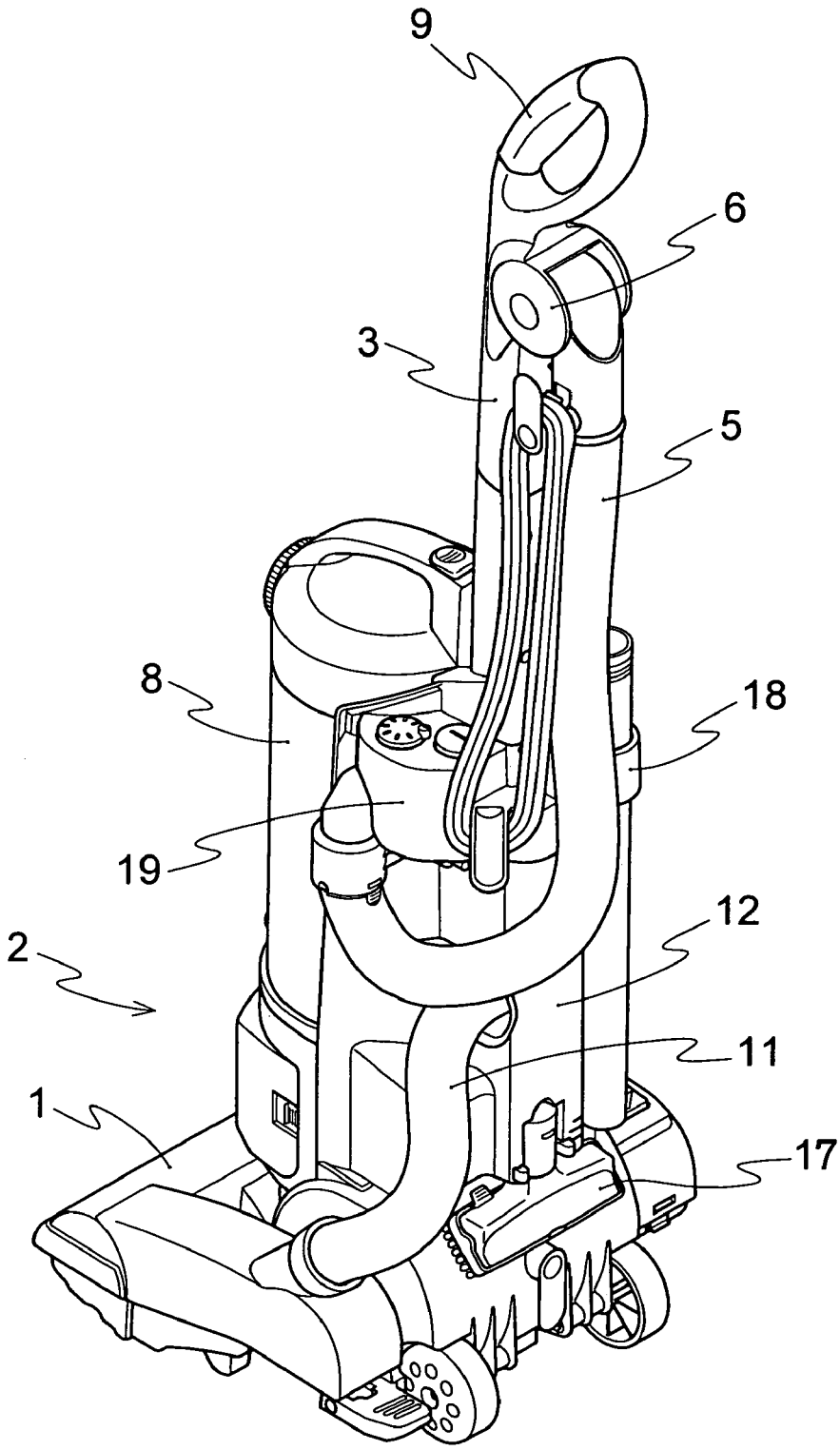
FIG. 3 is a perspective view of the electric vacuum cleaner of FIG. 1 when seen from the rear side.
Figure 9:
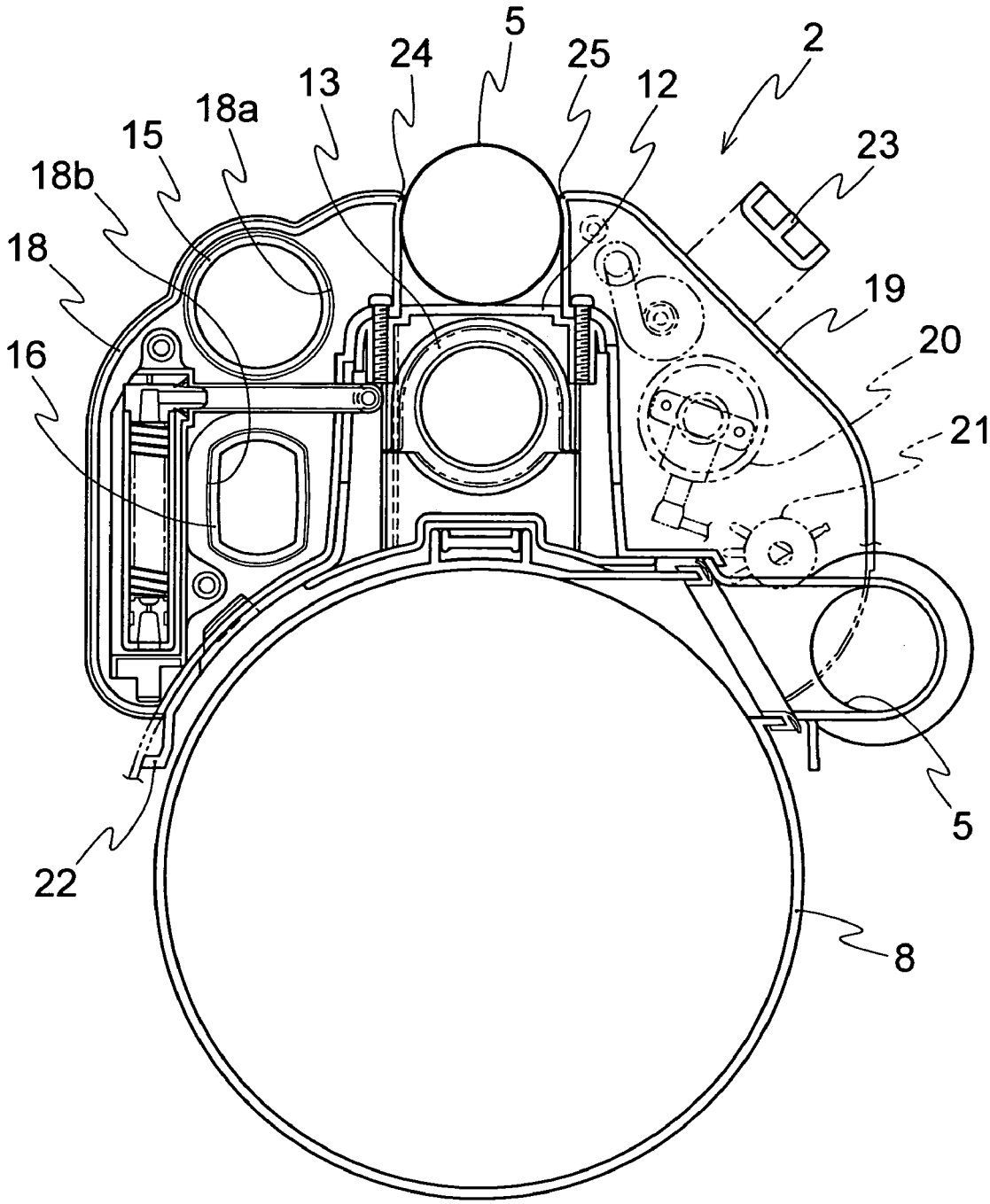
FIG. 9 is a horizontal sectional view of an interior of the rear portion of the vacuum cleaner main body of FIG. 1.

Further, the electric vacuum cleaner according to the present embodiment is provided, on both sides of the rear portion 12 of the vacuum cleaner main body 2 covering the dust box 8, with an attachment holding portion 18 and a switch box 19 incorporating therein electric components such as switches as illustrated in FIGS. 3, 6 and 9.

As illustrated in FIG. 9, the attachment holding portion 18 is provided with through holes 18*a* and 18*b* extending in a vertical direction for inserting and holding the above-described extension pipe 15 and the pipe for crevice 16 therein. In the switch box 19, electric components such as a main switch 20, a power control switch 21, or a fuse are housed. A cord hook 23 for hooking on and accommodating a power cord thereby is integrally formed on an outer peripheral surface of the switch box 19.

A case 22 having a semicircular arc-like shape of the vacuum cleaner main body 2 is provided on a rear surface side of the cylindrical dust box 8. The case 22 is formed of a single thin plate made of synthetic resin or the like for the purpose of slimming and weight-saving of the vacuum cleaner main body 2 and a strength thereof is thus weak. However, since the attachment holding portion 18 and the switch box 19 are fixed on both sides of the upper portion of the semicircular arc-shaped case 22 and the attachment holding portion 18 and the switch box 19 will concurrently serve as reinforcements of the case 22, the case 22 itself might be manufactured to be thin so that it is possible to achieve slimming and weight-saving of the vacuum cleaner main body 2.

The electric components such as the main switch 20, the power control switch 21, the fuse or a fixed portion of the power cord incorporated within the switch box 19 can be easily exchanged by simply detaching the switch box 19. For instance, by detaching one screw for fixing the switch box 19 to the vacuum cleaner main body 2 and two fixing screws of a switch cover on the lower surface of the switch box, it is possible to easily exchange those electric components.

Since protrusions 24 and 25 are provided at respective rear portions of the attachment holding portion 18 and the switch box 19, it is possible to hold the above-described flexible hose 5 by using these protrusions 24, 25.

Figure 10:
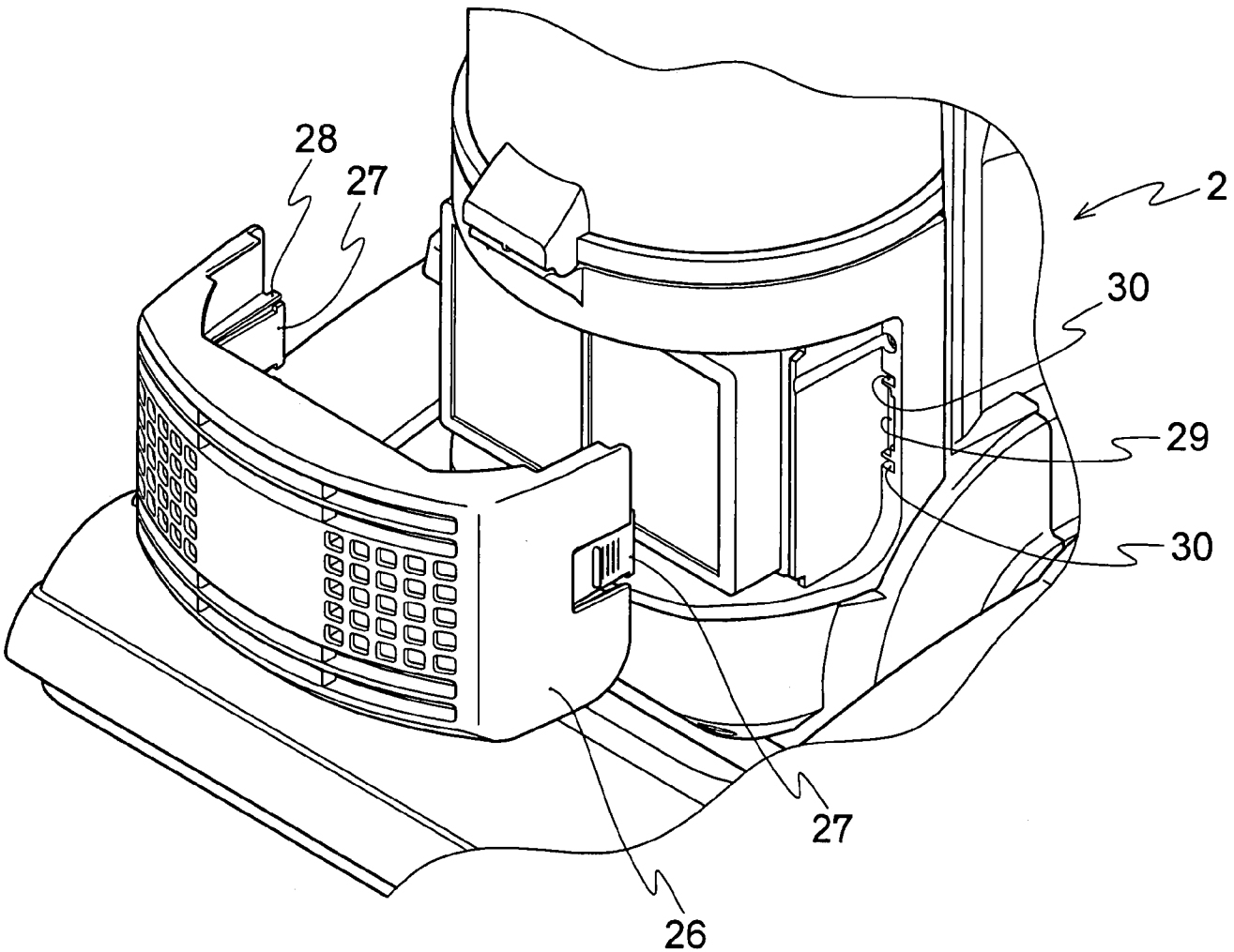
FIG. 10 is a perspective explanatory view when an exhaust cover of FIG. 1 is in course of being attached.
Figure 11:
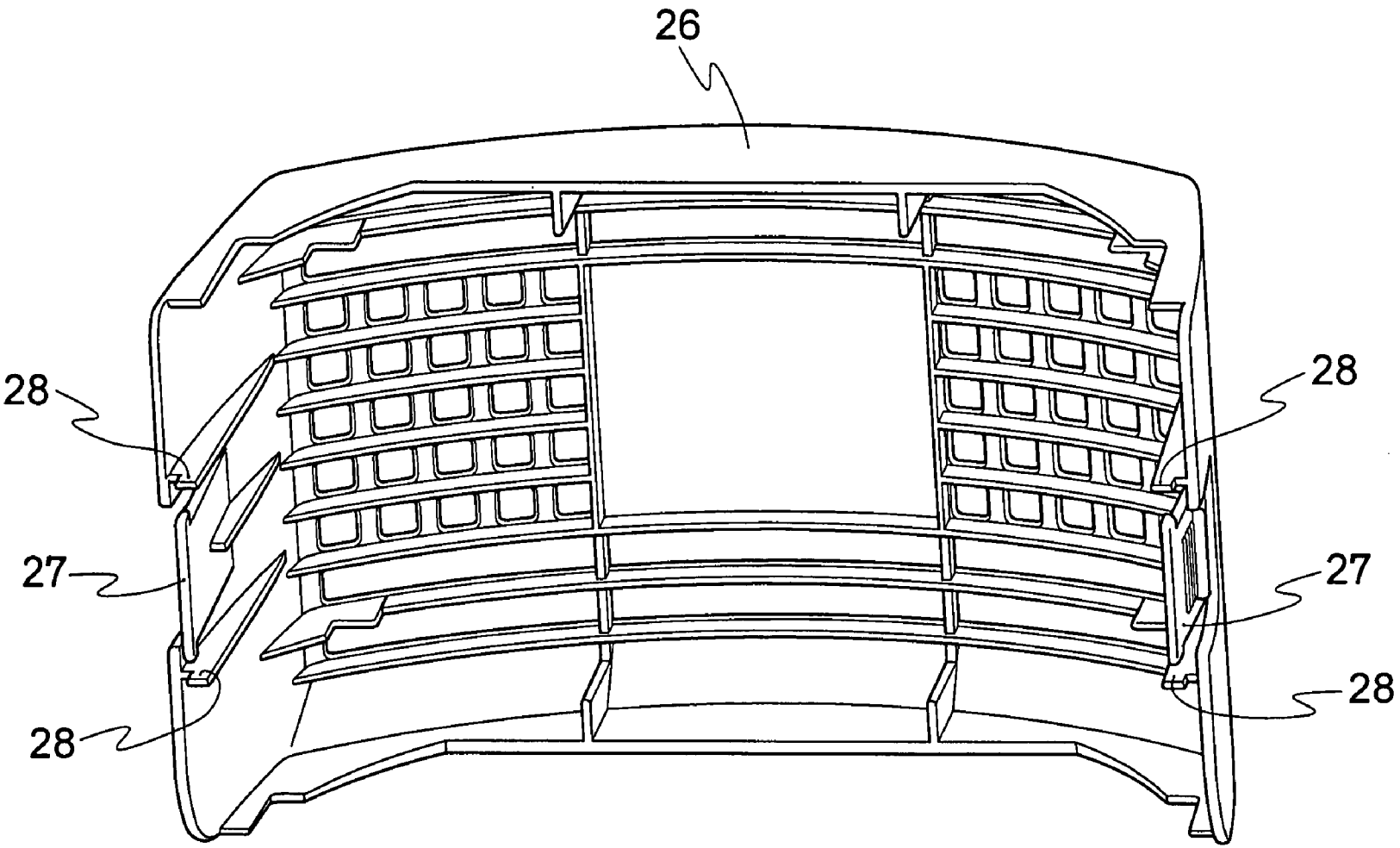
FIG. 11 is a perspective view when the exhaust cover of FIG. 1 is seen from inside.
Figure 12:
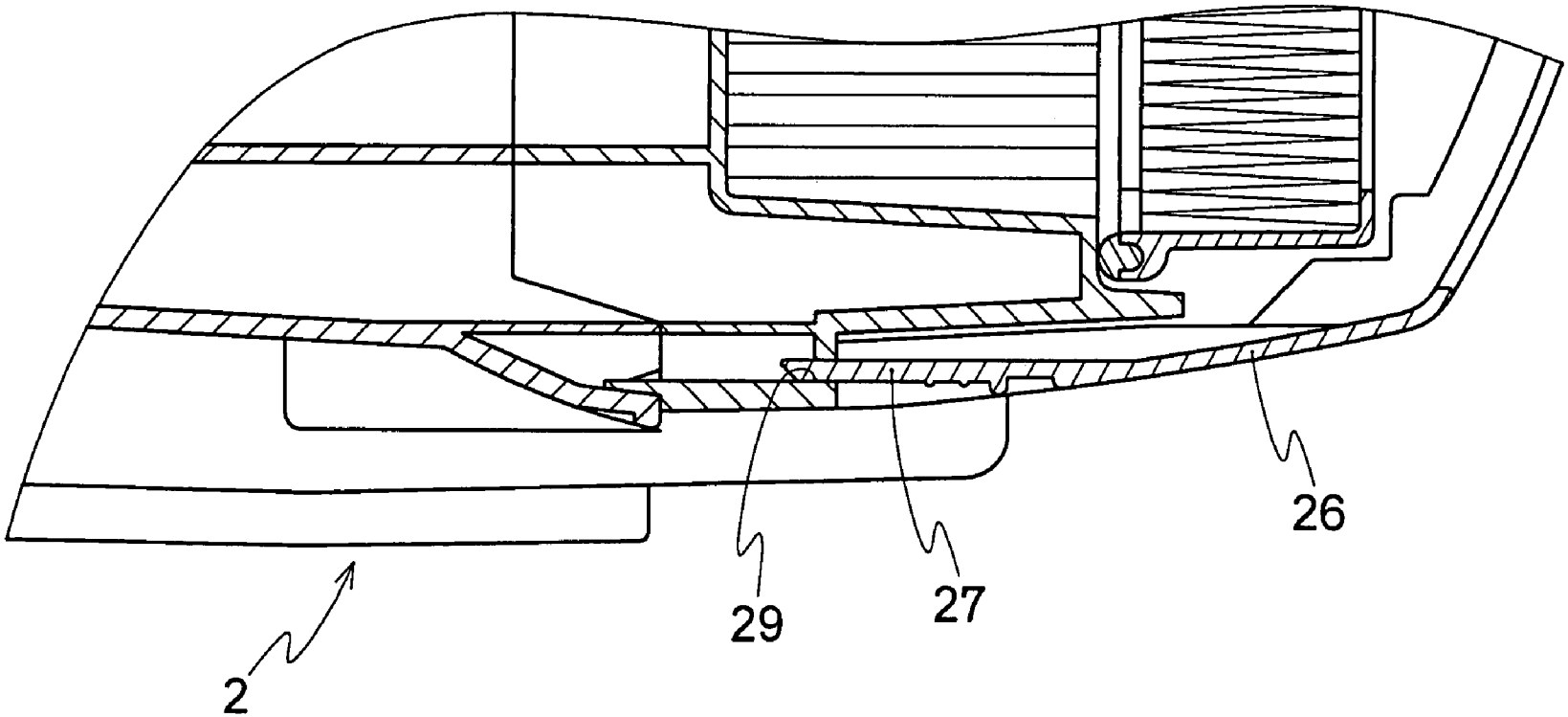
FIG. 12 is a sectional explanatory view of an engaging portion of a T-shaped hook of the exhaust cover of FIG. 1.

As illustrated in FIGS. 10 and 11, while an exhaust cover 26 attached to a front surface of the vacuum cleaner main body 2 tends to expand outside in a width direction of the exhaust cover 26 through exhausted air when being used, since tip ends of engaging portions such as T-shaped hooks 27 on both sides of the exhaust cover 26 are fixed, the T-shaped hooks 27 are deformed inward through wind pressure and heat of the exhausted air. While no wind pressure will be present when the power switch is turned OFF, the deformation of the T-shaped hooks 27 will be still remaining so that there is the fear that the T-shaped hooks 27 might come easily off the T-shaped concave portions 29 on the vacuum cleaner main body 2 side.

Accordingly, for preventing such falling off of the exhaust cover, the electric vacuum cleaner of the present embodiment is provided with a pair of protrusions 28 on both sides proximate of the T-shaped hooks 27 for attaching and detaching the exhaust cover 26 thereat as illustrated in FIGS. 10 to 13. On the other hand, the vacuum cleaner main body 2 is provided with a pair of concave portions 30 for engaging with the pair of protrusions 28 on both sides proximate of the T-shaped concave portions 29 for engaging with the T-shaped hooks 27.

Figure 13:
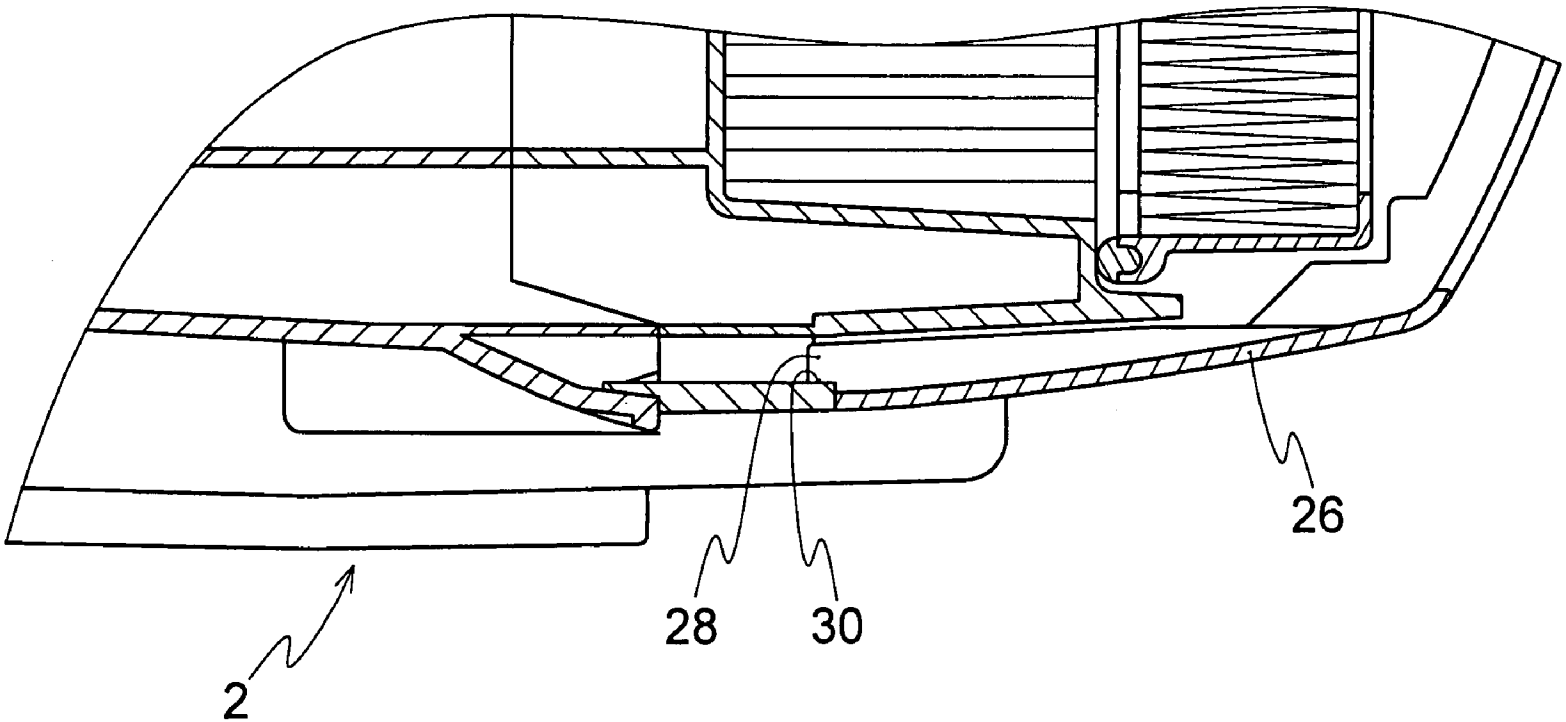
FIG. 13 is a sectional explanatory view of an engaging portion of a protrusion of the exhaust cover of FIG. 1.

Accordingly, when the exhaust cover 26 is fitted from the front of the vacuum cleaner main body 2 as illustrated in FIG. 10 such that the T-shaped hooks 27 engage with the T-shaped concave portions 29 (see FIG. 12), the protrusions 28 on both sides of the T-shaped hooks 27 can engage with the concave portions 30 on the vacuum cleaner main body side (see FIG. 13). Accordingly, even though pressure is applied through wind pressure of the exhausted air in a direction by which both side surfaces of the exhaust cover 26 expand outwardly at the time of using the cleaner, the engagement of the protrusions 28 on both sides of the T-shaped hooks 27 with the concave portions 30 will prevent outward deformation of both side surfaces of the exhaust cover 26 and thus preventing inward deformation of the T-shaped hooks 27. It is accordingly possible to prevent falling off of the above-described exhaust cover 26. Moreover, the engagement of the protrusions 28 and the concave portions 30 is a simple structure, and they can be manufactured at low costs.

According to the present invention, it is possible to perform both ordinary use (floor cleaning) using a suction tool main body and use of an attachment through a grip portion by utilizing one successive flow path so that it will not be necessary to provide a flow path switching mechanism to thereby simply the arrangement.

What is claimed is:

1. An electric vacuum cleaner comprising a vacuum cleaner main body, a suction tool main body connected to the vacuum cleaner main body and having an suction inlet which is open at a lower surface thereof, a dust box connected to the vacuum cleaner main body, and a grip portion for operating the vacuum cleaner main body, wherein said grip portion is connected to said dust box through a hose, wherein the suction tool main body and an interior of the vacuum cleaner main body are connected through a connecting hose, wherein the suction tool main body, the connecting hose, the interior of the vacuum cleaner main body, the grip portion and the dust box are directly connected in this order such that circulation of air is permitted, and wherein the interior of the vacuum cleaner main body and the grip portion are connected in a freely attachable and detachable manner, and the connecting hose is connected to the suction tool main body in a freely attachable and detachable manner.

2. The electric vacuum cleaner of claim 1, wherein a packing is provided at a connecting portion of a flow path between the interior of the vacuum cleaner main body and the grip portion.

3. The electric vacuum cleaner of claim 1, wherein at least a part of the connecting hose is extensible, and a part of the connecting hose is housed in the interior of the vacuum cleaner main body.

* * * * *

UNITED STATES PATENT AND TRADEMARK OFFICE

CERTIFICATE OF CORRECTION

PATENT NO. : 7,350,263 B2
APPLICATION NO. : 10/788118
DATED : April 1, 2008
INVENTOR(S) : K. Yoshimi et al.

It is certified that error appears in the above-identified patent and that said Letters Patent is hereby corrected as shown below:

In column 4 at line 9, please delete “comers” and insert --corners-- therefor.

Signed and Sealed this

Second Day of June, 2009

JOHN DOLL
*Acting Director of the United States Patent and Trademark Office*